United States Patent [19]

Read

[11] 4,197,194

[45] Apr. 8, 1980

[54] LOAM SCREENING APPARATUS

[76] Inventor: James L. Read, 189 Elm St., Halifax, Mass. 02338

[21] Appl. No.: 947,380

[22] Filed: Oct. 2, 1978

[51] Int. Cl.[2] ..... B07B 1/28

[52] U.S. Cl. ..... 209/325; 209/409; 209/421

[58] Field of Search ..... 37/117.5, DIG. 3, DIG. 12; 299/7; 214/17 C, 17 D; 171/63; 172/33, 67; 209/240, 243, 255, 315, 325–326, 329, 409, 420–421, 412, 270, 309

[56] References Cited

U.S. PATENT DOCUMENTS

| | | | |
|---|---|---|---|
| 1,806,934 | 5/1931 | Deister | 209/420 |
| 2,284,692 | 6/1942 | Strube | 209/326 |
| 2,319,725 | 5/1943 | Drinkwater | 209/370 |
| 2,983,381 | 5/1961 | Ball | 209/400 |
| 3,035,724 | 5/1962 | Clark et al. | 37/117.5 |
| 3,307,698 | 3/1967 | Haffner | 209/420 |

FOREIGN PATENT DOCUMENTS

| | | | |
|---|---|---|---|
| 1077822 | 11/1954 | France | 209/421 |

*Primary Examiner*—Frank W. Lutter
*Assistant Examiner*—Jon E. Hokanson
*Attorney, Agent, or Firm*—David E. Brook; James M. Smith

[57] ABSTRACT

A portable loam screening apparatus includes a nearly-square sloping shaker screen supported by a box-like frame. The frame has a tail end and a short end joined by two sides. Funneling surfaces directed toward the screen are provided along the upper edges of the tall end and the sides. The short end is closed to provide a wall between separated loam and coarse material. A mixture of loam and coarse material is dumped onto the shaker screen from the shovel of an excavating vehicle. The coarse material falls from the lower end of the shaker screen outside of the frame, and the loam passes through the shaker screen to within the box-like frame. The separated loam falls down a sloping table within the frame and can then be retrieved by an excavating vehicle through the open tall end of the frame. A set of wheels mounted to one side of the frame is moveable relative to the frame from an operative position for transporting the apparatus to an inoperative position for resting the frame flush on the ground. A trailer hitch is mounted to the other side of the frame and the shaker power source is mounted above the hitch.

8 Claims, 7 Drawing Figures

26
18
3A
30
60
35
70
68
64
58
62
32
28
31
66
20
29

60
64
62

38
78
40
42
22
24
30
60
33
14
39
20
11
28
32
62
37
54
56
16
12
27
44
46

LOAM SCREENING APPARATUS

BACKGROUND OF THE INVENTION

This invention relates to screening apparatus for separating loam from coarse material and more particularly to such an apparatus having a shaker screen.

In many separators known in the art, gravel or the like is laid across a vibrating shaker screen. The screen has a mesh size suitable for passing particles of a predetermined size therethrough while supporting and carrying larger particles to a chute, conveyor or the like. As a rule of thumb, it is generally stated that the downwardly sloping length of the shaker screen should be about two and a half times the width of the screen in order to maximize the separating rate and the quality of separation while keeping the separator to a reasonable size. Such separators generally require hoppers at the input end of the shaker screen to funnel the particles onto the screen. One or more output chutes or conveyors are also generally required to carry the separated material away from the shaker screen.

Rich soil, or loam, is presently in high demand. Due to many regional restrictions on excavating, however, those who supply loam must often go to remote locations that offer rough top soil and separate the loam from coarse material such as gravel, decaying roots, stumps and so on. In order to avoid having to transport both the loam and the coarse material, it is highly desirable that a portable apparatus be used for separating the loam from the coarse material. To this end, many past shaker screen separators mounted on a truck or trailer have been reduced-scale imitations of stationary separator plants. Such separators generally require a conveyor or chutes to carry the separated loam and coarse material away from the shaker screen. Also, because of the extended lengths and reduced widths of these shaker screen separators, the separators require infeed hoppers or conveyors. These separators have not been reliable in separating loam from extremely bulky material, such as root stumps and the like, which have clogged the hoppers or conveyors.

An object of the present invention is to provide a shaker screen separator for separating loam from exceptionally coarse material, that separator being portable for easy transport to the most remote regions.

A further object of this invention is to provide such a separator which is of exceptionally simple construction, not requiring the use of hoppers, chutes or conveyors.

Yet another object of this invention is to provide such a separator which is exceptionally durable even when used to separate the loam from heavy and bulky materials such as tree stumps and large rocks.

SUMMARY

In accordance with the invention in one of its aspects, a portable loam screening apparatus comprises a frame of generally rectangular cross section and having a tall end and a short end joined by sides, the short end being closed and the tall end being open. A loam separating shaker screen slopes downwardly from the tall end to an upper edge of the short end, and the downwardly sloping length of the shaker screen is about the same as the width of the screen between the frame sides.

In accordance with a further aspect of the invention, three funneling surfaces extend inwardly and downwardly from respective upper edges of the tall end and the sides of the frame.

A table within the frame slopes downwardly from the short end toward the tall open end to guide separated loam toward the open end.

A set of wheels is moveable relative to the frame from an operative position for transporting the apparatus, to an inoperative position for resting the frame flush on the ground. The wheels are mounted to one side of the frame and a trailer hitch is mounted to the other side. The power source for the shaker screen is also mounted to a side of the frame.

BRIEF DESCRIPTION OF THE DRAWING

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DESCRIPTION OF A PREFERRED EMBODIMENT

Figure 1:
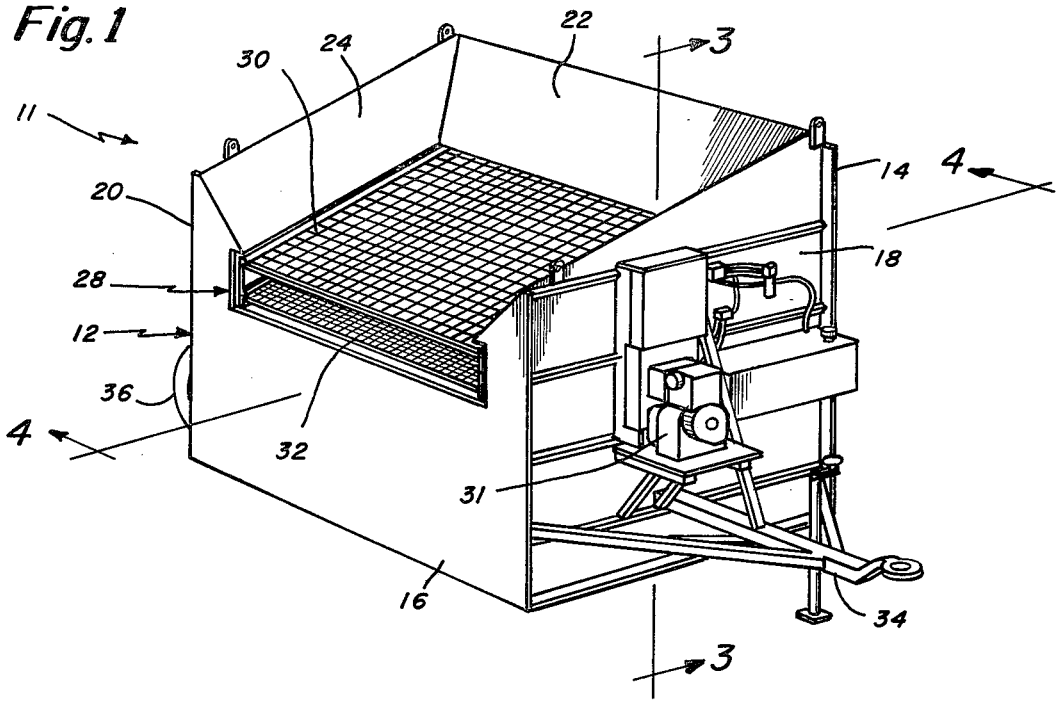
FIG. 1 is a front perspective view of the portable loam screening apparatus embodying the present invention.
Figure 2:
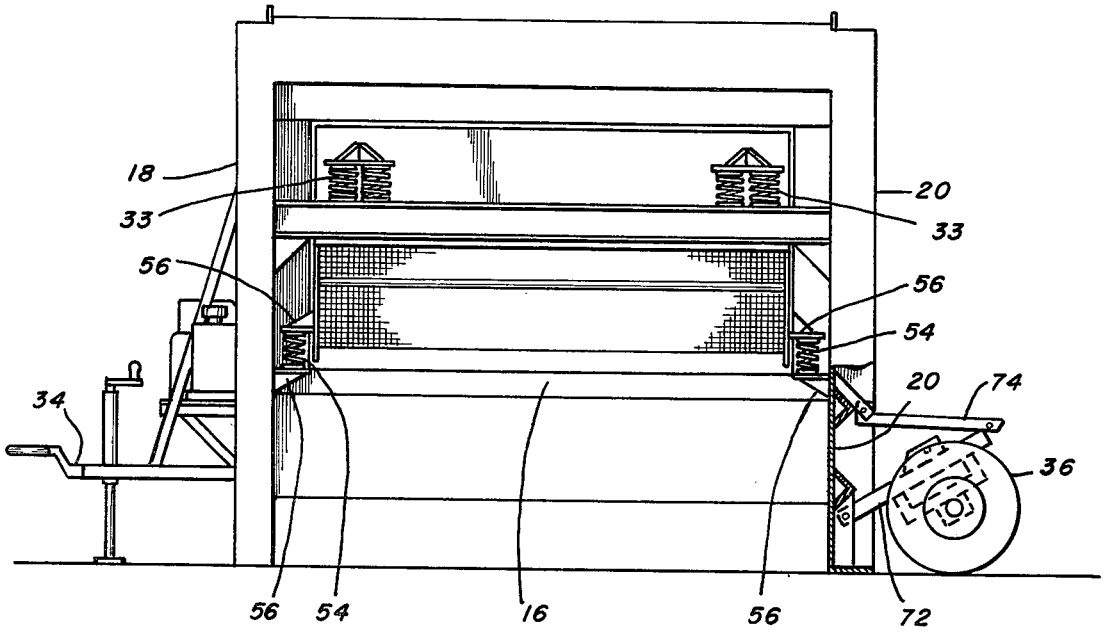
FIG. 2 is a rear view of the screening apparatus of FIG. 1.

As shown in FIG. 1, the loam separator 11 of the present invention has a box-like structural frame 12 having a generally rectangular horizontal cross section. The frame 12 has a tall rear end 14, a short front end 16 and sides 18 and 20. The front end 16 and sides 18 and 20 are closed while the tall end 14 is open. The frame thus forms a three sided enclosure the interior of which is shown in FIG. 2.

A funnel is formed at the top of frame 12 by funneling surfaces 22, 24 and 26 which extend downwardly and inwardly from the upper edges of the tall end and sides of the frame. A shaker assembly 28 is supported by the frame below the funneling surfaces 22, 24 and 26. This shaker assembly extends to the upper edge of the short end 16. A table 27 slopes downwardly from the short end 16 of the frame toward the open end 14. The table slopes at an angle of about 50° and extends about one-third of the length of the frame. It also extends across the entire width of the frame 12 between side walls 18 and 20.

Figure 3:
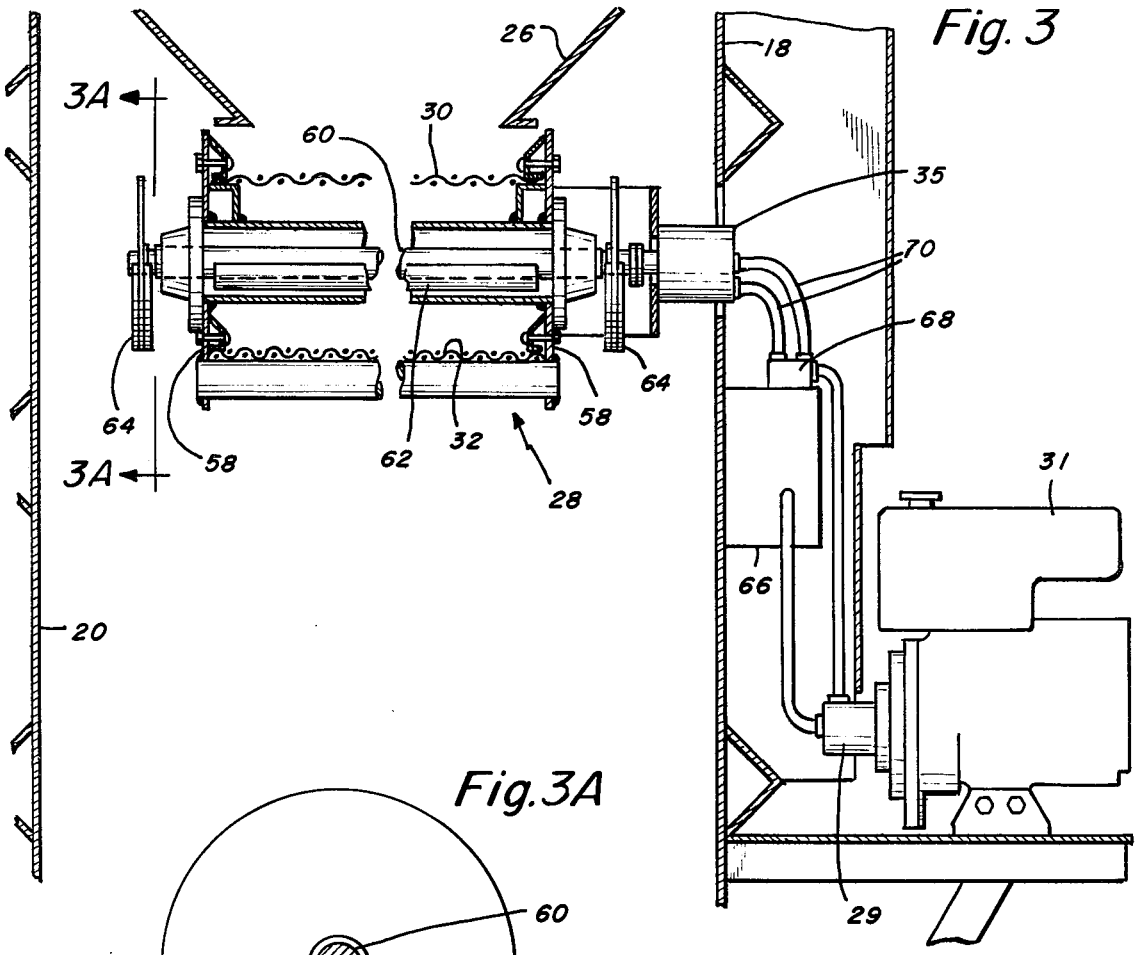
FIG. 3 is a partial cross sectional elevational view of the loam screening apparatus of FIG. 1, taken along line 3—3, and showing the shaker screen drive.
Figure 3A:
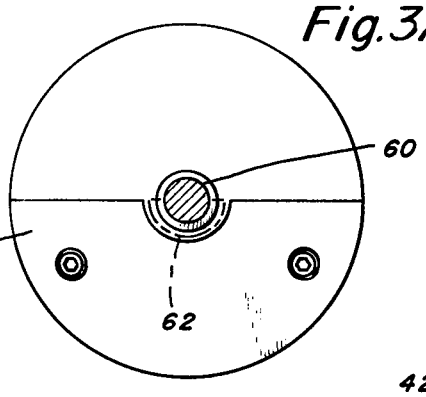
FIG. 3A is a side view of the off-balance fly wheel of the shaker screen drive taken along line 3A—3A of FIG. 3.

The shaker assembly 28 includes an upper screen 30 and a lower screen 32 stretched between side plates 58 (FIG. 3). The upper screen 30 is of a mesh size which separates very coarse material from loam and less coarse material; and the lower screen 32 is of a finer mesh which separates the remaining coarse material from the loam.

Figure 4:
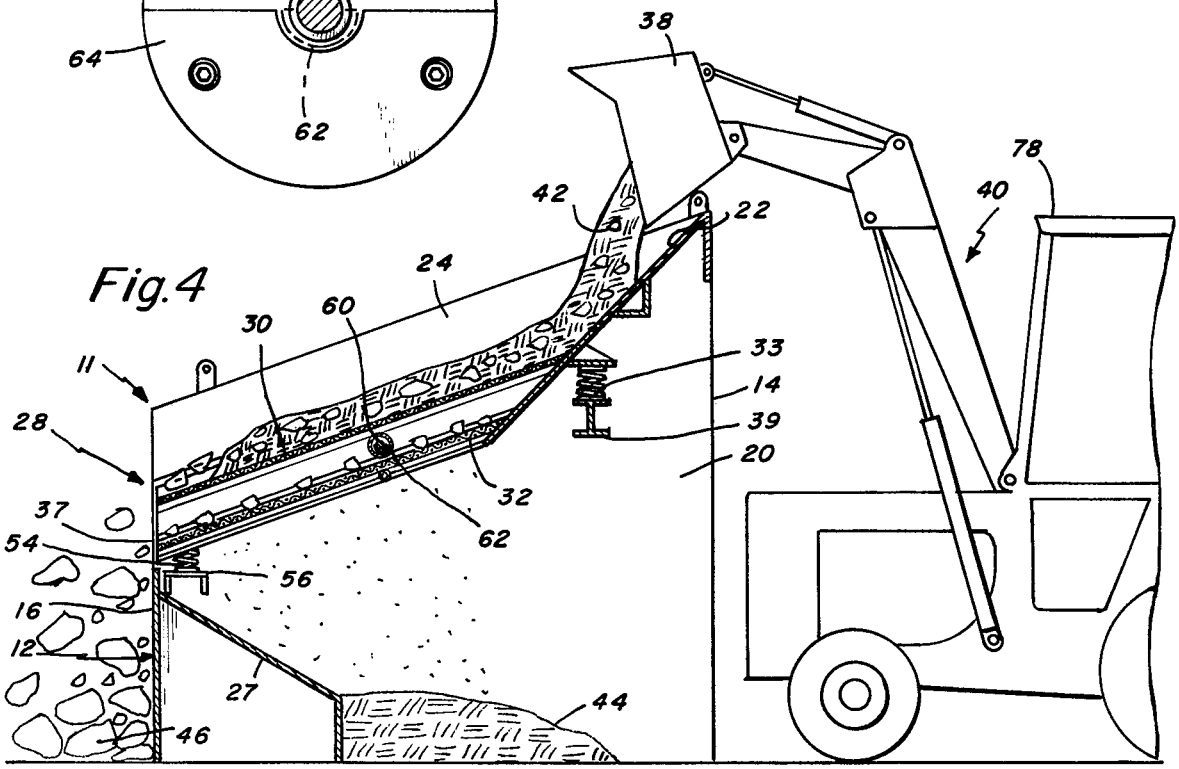
FIG. 4 is a cross sectional elevational view of the loam screening apparatus of FIG. 1, taken along line 4—4, and showing the loam and coarse material being dumped onto the shaker screen.

As shown in FIG. 4, the shaker screen assembly 28 is supported on front compression springs 54 and rear compression springs 33. The springs 54 rest on and are fixed to shelves 56 extending inwardly from respective side walls 18 and 20. Springs 33 rest on and are fixed to an I-beam 39 which extends between the side walls.

The assembly 28 bounces on the springs in a rotary movement through operation of an off-balance shaft mechanism shown in FIG. 3. Each side plate 58 has a bearing therein to support a shaft 60 for rotary movement. The shaft 60 has an off-balancing weight 62 welded to one side thereof. Also, an off-balance flywheel 64 is fixed to each end of the shaft 60. An hydraulic motor 35 mounted to one side of the plates 58 drives the shaft 60, and the resulting off-balance rotary movement of the shaft causes the assembly 28 to shake on springs 33 and 54.

The driving force for the hydraulic motor 35 is provided by oil from a tank 66. The oil is pumped through a valve 68 and flexible lines 70 by a pump 29. The pump 29 is mounted to a one cylinder diesel motor 31. The diesel motor 31 and tank 66 are both mounted to the side 18 of the frame.

Because the driving force for the shaker assembly is provided through flexible lines 70 the hydraulic motor 35 can be mounted directly to the shaker assembly and move with the assembly. A direct drive is thus possible from the hydraulic motor 35 to the off-balance shaft 60.

Figure 6:
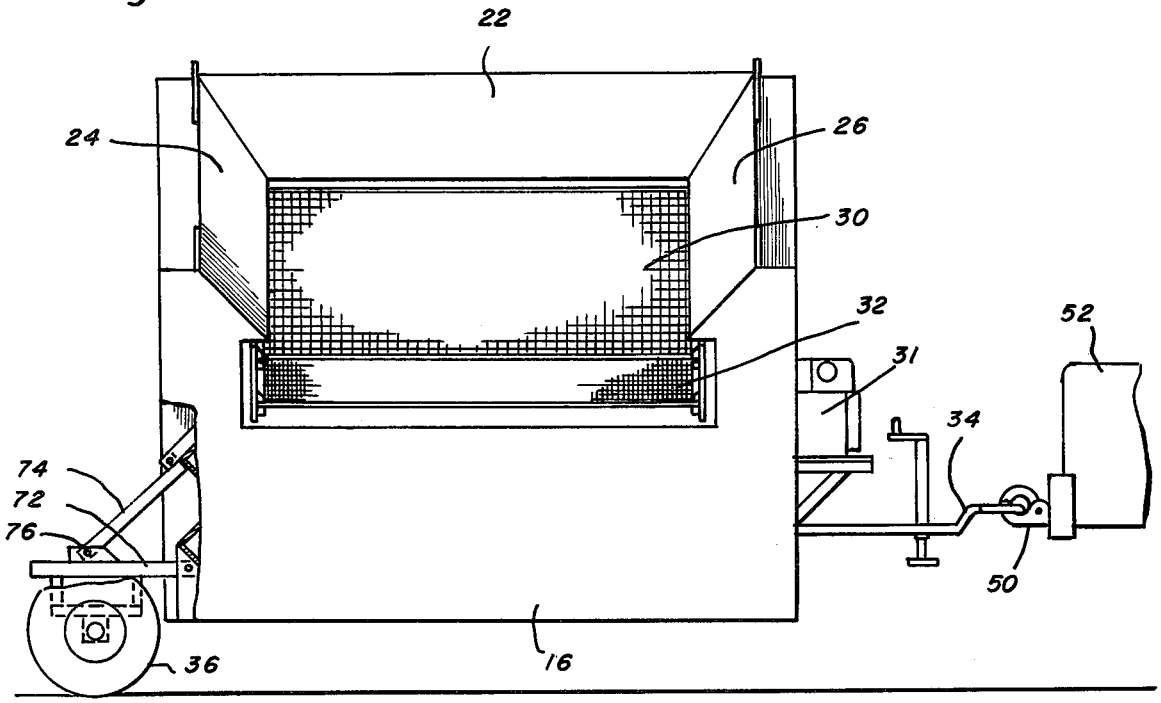
FIG. 6 is a front view of the loam screening apparatus of FIG. 1 but with the wheels, mounted to one side of the apparatus, in a transporting position, and the apparatus connected as a trailer behind a motor vehicle.

For transport of the loam screening apparatus 12, a trailer hitch 34 is connected to the side 18 and a set of wheels 36 is connected to the opposite side 20. The wheels 36 are mounted to pivotal arms 72 extending from the side 20. When the loam screening apparatus is in use, the arms 72 are pivoted up to the inoperative position of FIG. 2 so that the frame 12 rests flush on the ground. When the apparatus is to be transported, the side 20 is lifted a foot or more from the ground and braces 74 are secured by pins 76 to the arms 72 (FIG. 6). The side 20 can then be rested on the wheels 36 and the loam screening apparatus can be transported as a trailer.

Figure 5:
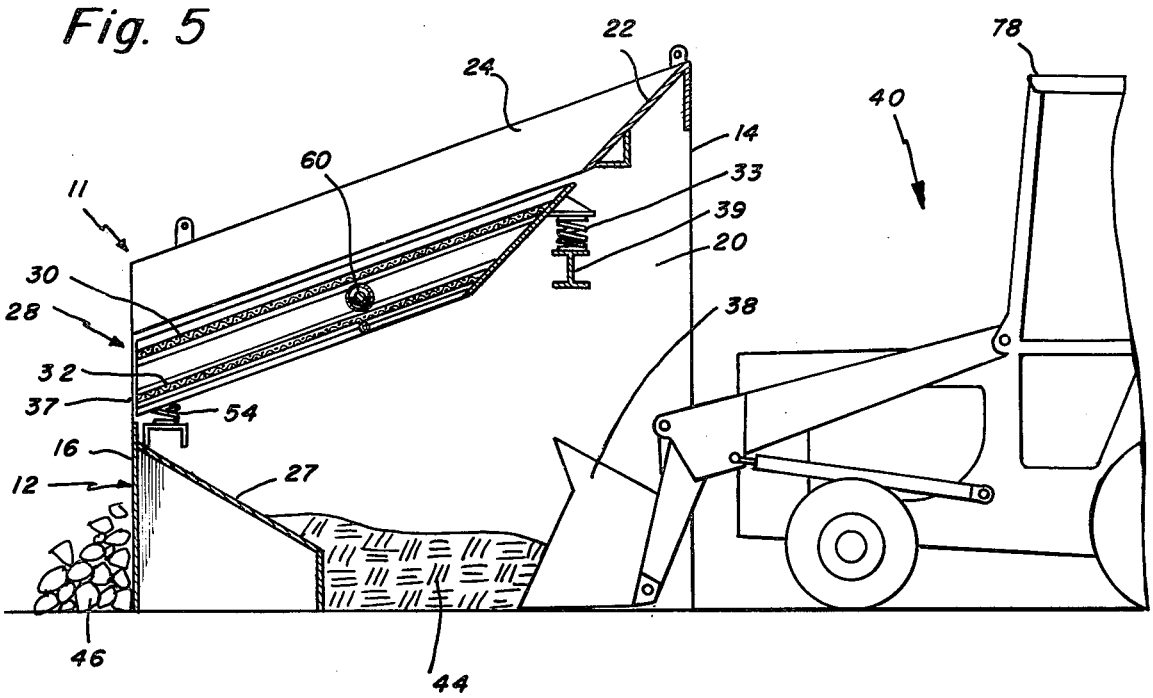
FIG. 5 is a cross sectional elevational view similar to FIG. 4 of the loam screening apparatus but showing loam being removed from within the apparatus frame.

Use of the loam screening apparatus of the present invention can best be understood with reference to FIGS. 4–6. With the wheels 36 pivoted to a raised inoperative position, the frame 12 rests flush on the ground. A load of loam and coarse material 42 is dumped from the shovel 38 of an excavating vehicle 40 onto the shaker screen assembly 28. The material 42 is dumped near the upper funneling surface 22. The vibrating movement of the shaker screen jars the loam loose from the coarse material, and the loam drops through the screens 30 and 32. Coarser material, unable to drop through the screens 30 and 32, moves down toward the lower end 37 of the shaker screens. The coarse material then drops from the end of the shaker assembly to a pile of coarse material 46. The loam, however, collects within the enclosure defined by the short end wall 16 and the sides 18 and 20. Any loam which falls on the sloping table 27 is directed by the table back toward the open end 14. The closed sides 18 and 20 prevent the loam from being blown from within the frame 12 by wind.

With the funneling surfaces 22, 24 and 26 there is no need for a hopper over the shaker screen. Also, the tall end 14 is sufficiently wide and low that the loam and coarse material can be loaded onto the shaker screen by an excavating vehicle such as vehicle 40 having a shovel 38.

Once one or more loads of loam and coarse material have been dumped onto the shaker and separated, the vehicle 40 can be used to scoop the separated loam from within the separator frame as shown in FIG. 5. The loam is then loaded onto a vehicle for transport, or it is set aside for later transport.

The lower end 37 of the shaker assembly is positioned over the short end wall 16. This end wall along with table 27, acts to keep the separated loam and coarse material separate until the loam is carried away. The end must be sufficiently tall to permit respective mounds 44 and 46 of loam and coarse material to build up without the need for continuous removal of the loam and coarse material. Also, the end 16 must be sufficiently tall to permit the shovel 38 of the payloader 40 to be moved within the enclosure of the separator frame to the end of table 27 to scoop out the loam. To this end, the short wall 16 of a preferred embodiment of the invention has a height of 43 inches.

The opening in the tall end 14 of the frame 12 must be sufficiently high to permit the payloader 40 to collect the loam from within the frame. This opening, the height of which is limited by the shaker supporting beam 39, must be somewhat higher than the 43 inches of the sorter end wall 16. The increased height, which is a preferred embodiment is about six feet, is possible due to the slope of the shaker screen. For proper operation of the shaker assembly described above, it is important that the shaker screens be pitched at an angle of between 16 and 24 degrees, preferably at about 20 degrees.

To efficiently load loam and coarse material onto the shaker assembly 28 by means of the shovel 38 (FIG. 4), it is necessary that the shaker assembly have a width in the order of the width of the shovel 38. To this end, the shaker assembly of a preferred embodiment is seven feet wide. Using the conventional rule of thumb, the length of the screen assembly would then be over 15 feet. Such a length would lead to several disadvantages. For one, the payloader 40 would be less likely to be able to reach sufficiently far into the separator frame to scoop out all of the loam. To reach the table 27, the vehicle 40 would have to follow the shovel 38 into the frame 12. For the vehicle to enter the frame 12, the opening end 14 would have to be much higher than the preferred six feet to clear the cab 78 of vehicle 40. With the required higher opening, the funneling surface 22 would be too high for convenient dumping of loam and coarse material thereover by the vehicle 40.

To meet the opposing requirements that the opening in end 16 be sufficiently high to permit the vehicle 40 to reach under the shaker assembly 28 to scoop out the separated loam, yet sufficiently low that the payloader be able to reach over the end 14 of the frame, the present shaker assembly is nearly square, but the downwardly sloping length of the assembly is less than the width of the assembly between the sides 18 and 20. In the preferred embodiment the assembly 28 is six and a half feet long.

The above dimensioning of the shaker assembly has other resultant advantages. It results in a very compact shaker assembly 28 which is supported by a concomitantly compact frame 12. The stout loam screening apparatus 11 is better able to handle bulky material, such as root stumps and the like, which is loaded onto the shaker screen along with the loam. Also, the frame 12 is sufficiently small to be towed along the highways behind a small vehicle as shown in FIG. 6.

In FIG. 6, the wheels 36 are pivoted downwardly relative to the frame 12 on support arms 38. As noted above, this lifts the side 20 of frame 12 off the ground. With subsequent attachment of the hitch 34 to a complimentary hitch 50 on a vehicle 52, the loam screening apparatus may be conveniently towed to any remote location in order that the loam may be separated from coarse material at the excavating site.

While the invention has been particularly shown and described with reference to a preferred embodiment thereof, it will be understood by those skilled in the art that various changes in form and detail may be made therein without departing from the spirit and scope of the invention as defined by the appended claims.

What is claimed is:

1. A portable screening apparatus for separating coarse material from finer material comprising:

a frame of generally rectangular cross section and having a tall end and a short end joined by sides, said short end being closed from an upper edge of said short end to the ground and the lower portion of said tall end being completely open from the ground to a height sufficiently high to permit a payloader to collect the finer material from within the frame;

said frame at said tall end having a width sufficient to accommodate the shovel of a payloader;

three funneling surfaces extending inwardly and downwardly from respective upper edges of said tall end and said sides of said frame;

a material separating shaker screen sloping downwardly from said tall end funneling surface along said side funneling surfaces to said short end near the upper edge thereof, said shaker screen having a near square upper surface;

a set of wheels mounted to one of said sides and movable relative to said frame from an operative position for transporting said apparatus to an inoperative position for resting said frame flush on the ground; and a trailer hitch mounted to the other side of said sides.

2. A portable screening apparatus for separating coarse material from finer material comprising:

a frame of generally rectangular cross section and having a tall end and a short end joint by sides, said short end being closed from an upper edge of said short end to the ground and the lower portion of said tall end being completely open from the ground to a height sufficiently high to permit a payloader to collect the finer material from within the frame;

said frame at said tall end having a width sufficient to accommodate the shovel of a payloader;

a material separating shaker screen sloping downwardly from near the upper edge of said tall end to near the upper edge of said short end;

a set of wheels mounted to one of said sides and movable relative to said frame from an operative position for transporting said apparatus to an inoperative position for resting said frame flush on the ground; and a trailer hitch mounted to the other of said sides.

3. A portable screening apparatus as claimed in claim 1 or 2 wherein said sides are closed.

4. A portable screening apparatus as claimed in claim 1 or 2 wherein a power source for said shaker screen is mounted to a side of said frame.

5. A portable screening apparatus as claimed in claim 1 or 2 wherein the downwardly sloping length of said shaker screen is less than the width of said screen.

6. A portable screening apparatus claimed in claim 1 or 2 further comprising a table within said frame between the sides of said frame, said table sloping downwardly from said short end toward said tall end.

7. A portable screening apparatus for separating coarse material from finer material comprising:

a frame of generally rectangular cross section and having a tall end and a short end joined by sides, said short end being closed from an upper edge of said short end to the ground and the lower portion of said tall end being completely open from the ground to a height sufficiently high to permit a payloader to collect the finer material from within the frame;

said frame at said tall end having a width sufficient to accommodate the shovel of a payloader;

a material separating shaker screen sloping downwardly from near the upper edge of said tall end to near the upper edge of said short end;

a table within said frame, said table sloping downwardly from said short end toward said tall end;

a set of wheels mounted to one of said sides and movable relative to said frame from an operative position for transporting said apparatus to an inoperative position for resting said frame flush on the ground; and a trailer hitch mounted to the other of said sides.

8. A portable loam screening apparatus for separating coarse material from finer material comprising:

a frame of generally rectangular cross section and having a tall end and a short end joined by sides, said short end being closed from an upper edge of said short end to the ground and said sides being closed and the lower portion of said tall end being completely open from the ground to a high sufficiently high to permit a payloader to collect the finer material from within the frame;

said frame at said tall end having a width sufficient to accomodate the shovel of a payloader, three funneling surfaces extending inwardly and downwardly from respective upper edges of said tall end and said sides of said frame;

a material separating shaker screen sloping downwardly from said tall end funneling surface along said side funneling surfaces to near an upper edge of said short end, the downwardly sloping length of said shaker screen being nearly equal to the width of said screen between side funneling surfaces;

a table within said frame between the sides of said frame, said table sloping downwardly from said short end toward said tall end;

a set of wheels mounted to one of said sides and moveable relative to said frame from an operative position for transporting said apparatus to an inoperative position for resting said frame flush on the ground; and a trailer hitch mounted to said side of said frame opposite to said set of wheels.

* * * * *